United States Patent [19]

Holley

[11] Patent Number: 4,691,639

[45] Date of Patent: Sep. 8, 1987

[54] RAIL TIE PLATE PLACING VEHICLE AND METHOD

[75] Inventor: John D. Holley, Montgomery, Ala.

[73] Assignee: Holley Engineering Company, Inc., Montgomery, Ala.

[21] Appl. No.: 826,008

[22] Filed: Feb. 4, 1986

[51] Int. Cl.[4] ..... E01B 29/32

[52] U.S. Cl. ..... 104/16; 104/307

[58] Field of Search ..... 104/1 R, 2, 5, 16, 307; 198/690.1, 463.4; 221/212

[56] References Cited

U.S. PATENT DOCUMENTS

| | | | |
|---|---|---|---|
| Re. 27,604 | 3/1973 | Stewart | 104/12 |
| 2,671,414 | 3/1954 | Moe | 104/5 |
| 2,924,323 | 2/1960 | Holben | 198/463.4 X |
| 3,084,779 | 4/1963 | Mladek et al. | 198/463.4 X |
| 3,157,267 | 11/1964 | Asbury | 198/310 |
| 3,523,602 | 8/1970 | Mojden et al. | 198/690.1 X |
| 3,654,868 | 4/1972 | Plasser et al. | 104/2 |
| 3,690,264 | 9/1972 | Plasser et al. | 104/17 R |
| 3,701,320 | 10/1972 | Fearon et al. | 104/16 X |
| 3,731,455 | 5/1973 | Theurer | 53/391 |
| 3,737,822 | 6/1973 | Buus et al. | 198/690.1 X |
| 3,795,301 | 3/1974 | Sugitani | 198/690.1 X |
| 3,842,965 | 10/1974 | Pfaffle | 198/463.4 |
| 4,178,236 | 12/1979 | Theurer | 209/215 |
| 4,178,237 | 12/1979 | Theurer | 209/215 |
| 4,225,429 | 9/1980 | Holley | 209/215 |
| 4,241,663 | 12/1980 | Lund et al. | 104/16 |
| 4,280,613 | 7/1981 | Stewart | 104/16 X |
| 4,478,152 | 10/1984 | Holley | 104/279 |
| 4,942,000 | 3/1976 | Dieringer | 250/222.1 |
| 4,943,858 | 3/1976 | Dieringer et al. | 104/16 |

*Primary Examiner*—Randolph A. Reese

*Attorney, Agent, or Firm*—Kerkam, Stowell, Kondracki, & Clarke

[57] ABSTRACT

A railroad tie plate placing vehicle uses a crawler track to place plates upon rail ties. The crawler track is meshed to a magnetic wheel which holds tie plates to the crawler track until the tie plates have actually contacted a tie. The crawler track at least partially propels the vehicle down the railroad track when the vehicle is placing plates. A tie detector switch is used to control gates which gate tie plates onto the conveyor and magnetic wheel upon detection of a tie such that a tie plate released by the gates will reach a release point in the closed loop of the conveyor at the same time as the release point reaches the tie whose detection triggered the gating of the tie plate.

30 Claims, 12 Drawing Figures

FIG 11
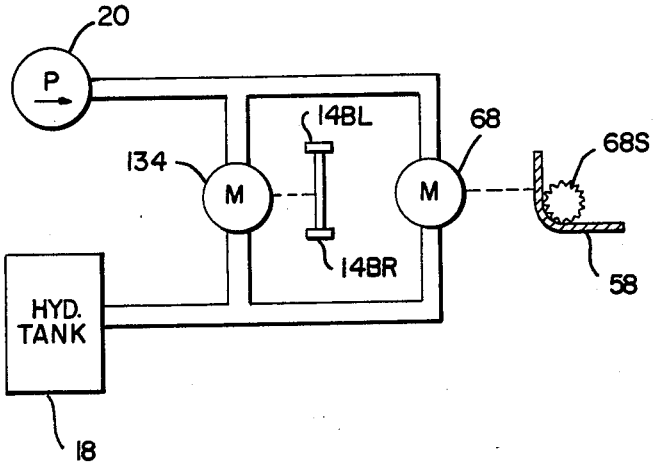
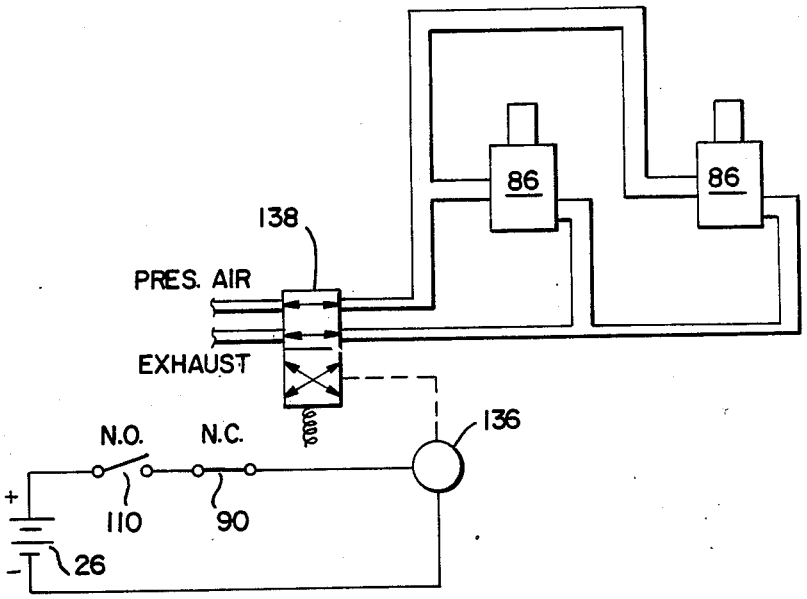
FIG 12

RAIL TIE PLATE PLACING VEHICLE AND METHOD

BACKGROUND OF THE INVENTION

This invention relates to a tie plate placing vehicle and associated method of placing tie plates.

When laying a new railroad track or when laying new rails upon a previously existing railroad track, it is necessary to provide tie plates upon the railroad ties. One tie plate is required for each side of each tie and typically more than three thousand tie plates would be required for one mile of track.

The tie plates may be manually placed upon each of the ties after the tie plates have been placed in piles along side the track. Typically, the tie plates are distributed by a crane having a magnetic head which drops piles of tie plates along side the track. The distance between the piles depends upon the average number of tie plates carried by the magnetic head of the crane. A work gang of about 10 to 15 persons would take tie plates from the pile and properly position them upon the railroad ties. Considering that the tie plates weigh about 28 pounds each and that the tie plates should be placed in the proper position on the tie, it will be appreciated that this method of placement involves high labor costs, inconsistent accuracy of placement, and a time consuming process.

Various machines have been developed in an attempt to avoid the manual method of tie plate placement. In particular, U.S. Pat. No. 3,943,858 issued to Dieringer et al on Mar. 16, 1976 and U.S. Pat. No. 4,241,663 issued to Lund et al on Dec. 30, 1980 show such machines.

The Dieringer et al patent shows a tie plate placement arrangement using a finger for sensing tie position. Upon detection of a tie, the machine is designed to stop over each tie and operate gating fingers to drop each tie plate upon the corresponding tie. A track mechanism may be used to support one side of the vehicle and a conveyor belt arrangement is used for conveying tie plates on the machine.

The Lund et al patent shows an arrangement in which tie plates are placed upon ties by a device including a chute. Tie plates are gated into the chute and an electromagnet is used to hold a tie plate in position such that it will be properly dropped over a tie as determined by a limit switch which is tripped by contact of a tie detector with a tie.

There have been a number of problems associated with various of the prior art methods and devices for distribution of tie plates along ties.

The manual method of tie plate distribution is subject to high labor costs, inconsistent accuracy of placement, and relative slow speed of tie plate distribution, whereas the prior machines for tie plate distribution are often subject to the last two disadvantages. More specifically, the machines often rely upon dropping of tie plates onto the tie such that the placement accuracy is limited by this factor. Additionally, machines which must stop in order to drop or place a tie plate are generally slow in placing tie plates along a given stretch of railroad track, whereas plate placing machines which drop the ties while the machine is moving are often subject to greater inaccuracy.

Various of the prior art plate placing machines have been quite complex in construction and, therefore, relatively expensive.

Prior placer machines which require electro magnets typically require relatively high power electric energy sources.

OBJECTS AND SUMMARY OF THE INVENTION

Accordingly, it is a primary object of the present invention to provide a new and improved rail tie plate placing vehicle.

Another object of the present invention is to provide a new and improved tie plate placing method.

A more specific object of the present invention is to provide tie plate placement in a relatively speedy fashion.

A further object of the present invention is to provide relatively accurate placement of tie plates.

A still further object of the present invention is to provide tie plate placement at a relatively low operational cost and with relatively low labor cost.

Objects of the present invention also include overcoming or minimizing the problems common with prior art plate placement techniques. These and other objects which will become more apparent from the following are realized by a rail tie plate placing vehicle comprising: a main frame; a moving conveyor extending in a closed loop, the conveyor supported by the main frame and operable in a plate placing mode to place tie plates upon ties of a railroad track as the vehicle moves down the railroad track; a first gate for gating the conveyance of tie plates by the conveyor, the first gate disposable in a blocking state wherein it blocks the conveyance of a leading tie plate and disposable in an open state wherein it allows passage of a leading tie plate for conveyance by movement of the conveyor; holding means for holding tie plates against the conveyor and allowing the release of tie plates at a common predetermined release point of the closed loop for immediate disposal upon a tie; and a tie detector supported by the main frame for detection of ties at a detection point forward of the release point; and wherein the tie detector causes the first gate to open for passage of a tie plate corresponding to the detection of a tie, and wherein the conveyor is operable such that the tie plate allowed passage by the first gate arrives at the release point when the vehicle has moved the release point over the detected tie. Preferably, the conveyor is operable to propel the vehicle along a track. The conveyor is disposed to contact ties along the track and the weight of the vehicle causes tie plates to stop moving with the vehicle such that each tie plate is deposited upon a tie. The conveyor is preferably a crawler track. The conveyor is a flexible conveyor having a plate conveying surface with an upwardly facing portion, a downwardly facing portion, and a transitional portion between the upwardly facing portion and the downwardly facing portion. The invention further comprises holding means cooperating with the conveyor for holding tie plates against the transitional and downwardly facing portions of the plate conveying surface and for releasing tie plates at the release point which is located at the downwardly facing portion. The vehicle further comprises a magnetic wheel rotating upon movement of the conveyor. The holding means comprises a plurality of permanent magnets mounted to the magnetic wheel. The tie detector is a switch mounted for accuation by ties. The distance from the first gate to the release point is equal to the distance from the detection point to the release point. The tie detector causes the first gate to assume its open state immediately upon detection of a tie. A plate detector detects a tie plate at a place on the conveyor downstream of the first gate and causes the first gate to assume its blocking state prior to complete passage of a leading tie plate past the first gate such that the leading tie plate moves with the conveyor, but any following tie plate is blocked. The first gate is mounted adjacent a first side of the conveyor. A second gate is mounted adjacent a second side of a conveyor and operable in like fashion with the first gate for simultaneously gating tie plates by joint action of the first and second gates.

The invention may alternately be described as a rail tie plate placing vehicle comprising: a main frame; a moving closed loop flexible conveyor supported by the main frame and operable in a plate placing mode to place tie plates upon ties of a railroad track, and wherein the conveyor includes a plate conveying surface having an upwardly facing portion, a downwardly facing portion, and a transitional portion between the upwardly facing portion and the downwardly facing portion; and holding means cooperating with the conveyor for holding tie plates against the transitional and downwardly facing portions of the plate conveying surface and releasing tie plates at a release point from the downwardly facing portion for placement upon ties. The vehicle may further comprise an inclined conveying means having a plate placement surface adapted to receive tie plates thereon for movement to a lower end of the conveying means, and wherein the lower end terminates above the conveyor such that tie plates placed on the conveying means are deposited upon the conveyor.

The method of the present invention may be described as a method of placing tie plates upon ties from a tie plate placing vehicle, the steps comprising: moving the vehicle along a railroad track; detecting ties on the railroad track; gating a tie plate by way of a first gate for movement with a closed loop, moving conveyor for each detected tie; moving each gated tie plate to a release point on a conveyor such that the gated tie plate is at the release point when the vehicle has moved sufficiently that the release point is immediately over the detected tie whose detection caused the gating of that gated tie plate; and releasing each gated tie plate when it arrives at the release point. Preferably, the tie plate is gated for movement with the conveyor upon the detection of a tie. The conveyor is moving at the same speed as the vehicle. The method further comprises the step of propelling the vehicle by movement of the conveyor. The vehicle is moving during the releasing step. The conveyor is a crawler track which contacts the railroad track and the releasing step results from the weight of the vehicle causing tie plates to stop moving with the vehicle such that each tie plate is deposited upon a tie. The method further comprises the steps of detecting plates at a place on the conveyor downstream of the first gate and causing the first to assume a blocking state upon detection of a plate. The method further comprises the step of holding tie plates to the conveyor by permanent magnets in a magnetic wheel which rotates upon movement of the conveyor. The releasing step occurs upon a tie plate contacting a tie, while the tie plate is still in contact with the conveyor.

BRIEF DESCRIPTION OF THE DRAWINGS

The above and other features of the present invention will be more readily understood when the following detailed description is considered in conjunction with the accompanying drawings wherein like characters represent like parts throughout the several views and in which:

FIG. 11 shows a simplified hydraulic circuit for use in propulsion of the present vehicle.

FIG. 12 shows the pneumatic gating circuit and its electrical control circuit for use with the present invention.

DETAILED DESCRIPTION OF THE PREFERRED EMBODIMENTS

Figure 1:
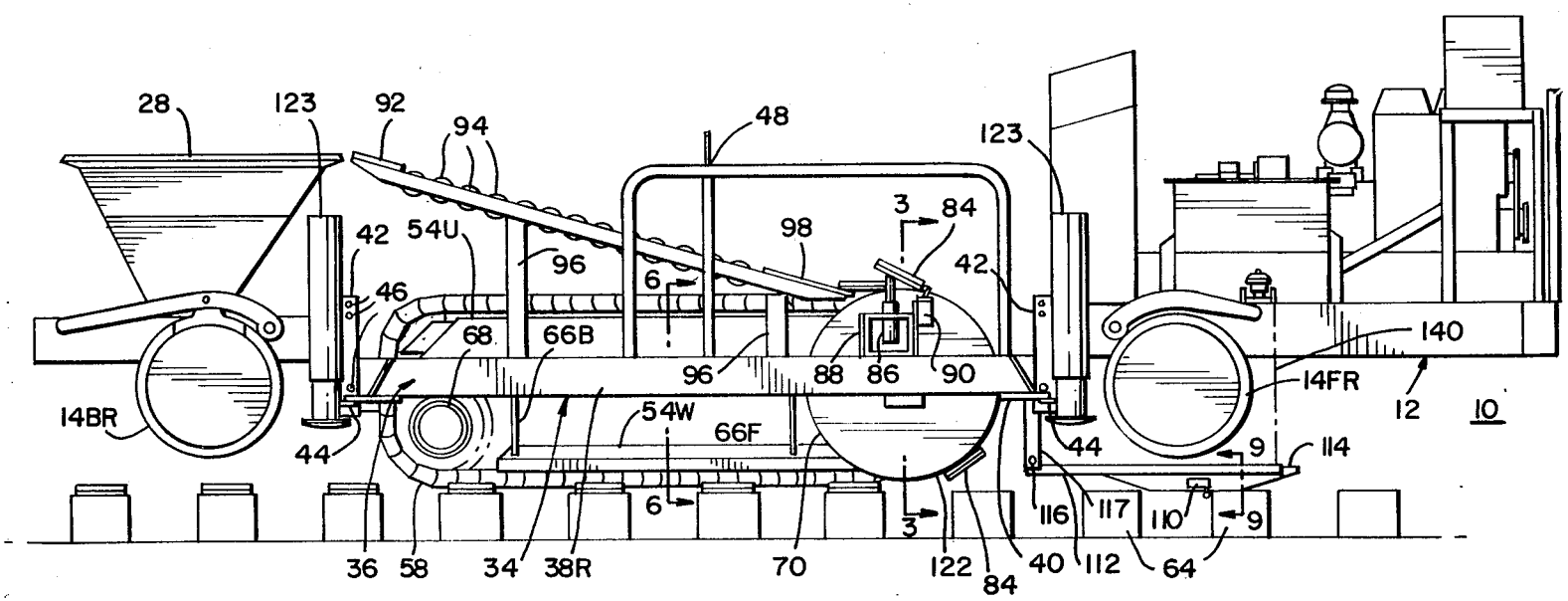
FIG. 1 shows a simplified side view of the vehicle according to the present invention.

Initially considering the side view of FIG. 1 and the top view of FIG. 2, the general structure of the plate placing vehicle 10 of the present invention will be discussed. The vehicle 10 includes a main frame 12 and four wheels arranged in a front pair 14FR and 14FL and a back pair 14BR and a back left wheel (not visible in the drawings but in a symmetric postion as the right wheel 14BR). The four wheels support the vehicle 10 for movement along a railroad track having two rails. The frame 12 may also include parts which extend between the front pair of wheels and the back pair of wheels.

The front of the vehicle 10 includes an engine 16, hydraulic oil tanks 18, pumps 20, a fuel tank 22, a battery 24, and an air tank 26. Mounted at the back of the vehicle 10 is storage bin 28 into which tie plates may be placed. Although the vehicle 10 might include a crane or other arrangement to place tie plates within the bin 28, this is not a necessary part of the present invention.

A center platform 30 extends lengthwise along the center of the vehicle, whereas a side platform 32 extends along the left side of the vehicle 10. The platform 30 and 32 provide a space where one or more persons may stand during operation of the vehicle 10.

Figure 6:
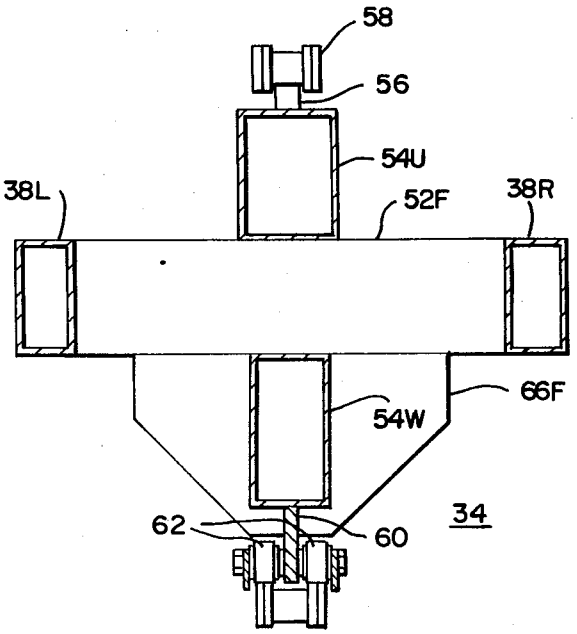
FIG. 6 shows a cross sectional taken along lines 6—6 of FIG. 1.

Continuing to view FIGS. 1 and 2, but also considering the cross sections views of FIGS. 3 and 6 respectively taken along lines 3—3 and 6—6 of FIG. 1, the construction of a placer assembly 34 will be described. It is the placer assembly 34 which functions to place tie plates upon the tie during operation of the vehicle 10.

The placer assembly 34 includes a frame structure 36. This placer frame 36 includes right and left members 38R and 38L which extend lengthwise completely along the placer assembly 34. Additionally, the members 38R and 38L allow the placer assembly 34 to be secured to either side of the vehicle 10. Although various arrangements could be used, the illustrated arrangement has lower pieces 40 mounted on the bottom of the members 38R and 38L. The lower pieces 40 are bifurcated so as to have a channel which accommodates mounting pieces 42, which mounting pieces 42 are vertical strips secured to the frame of the vehicle itself. There are four of the mounting pieces 42 upon each side of the vehicle (see especially FIG. 2) such that the side platform 32 may be interchanged with the placer assembly 34 depending upon which side of the track tie plates are required to be placed. The mounting pieces 42 have lower stops 44 which prevent the placer assembly 34 from falling below the level shown in FIG. 1. Additionally, the mounting pieces 42 include 3 holes 46. Each of the holes 46 may receive a locking pin (not shown) which would secure the placer assembly 34 in different positions. That is, the lower hole 46 may be pinned when the placer assembly 34 is in the position shown in FIG. 1 such that the lower pieces 40 would be captured between the pin corresponding to lower hole 46 and the stops 44. When the vehicle 10 is moving along a section of track which does not need tie plates placement and which has two rails, the placer assembly 34 may be moved upwardly by removing the pins in the lower holes 46, attaching a crane or otherwise lifting the placer assembly 34 by way of upper members 48 (FIG. 1 only), which upper members are secured to the placer frame 36. When the lower pieces 40 are disposed between the two upper locking holes 46 within the vertical strip mounting pieces 42, locking pins may be placed in the two upper holes 46 for each of the pieces 42, thereby capturing the lower pieces 40 therebetween to secure the placer assembly 34 in an upper or inoperative position.

An optional platform 50 (FIG. 2 only) may be secured to the placer frame 36 to allow a person to stand thereon for loading tie plates from the bin 28 onto the placer assembly 34.

The placer frame 36 further includes front and back transverse members 52F and 52B extending between the side members 38R and 38L. The transverse members 52F and 52B support lengthwise extending upper and lower members 54U and 54W. The lower member 54W is supported from front and back plates 66F and 66B. As best shown in FIG. 6, the upper member 54U has a track bar 56 to accommodate rollers of a chain roller type conveyor 58. The lower member 54W includes a member 60 having rollers 62 mounted thereon for cooperation with the conveyor 58.

Figure 2:
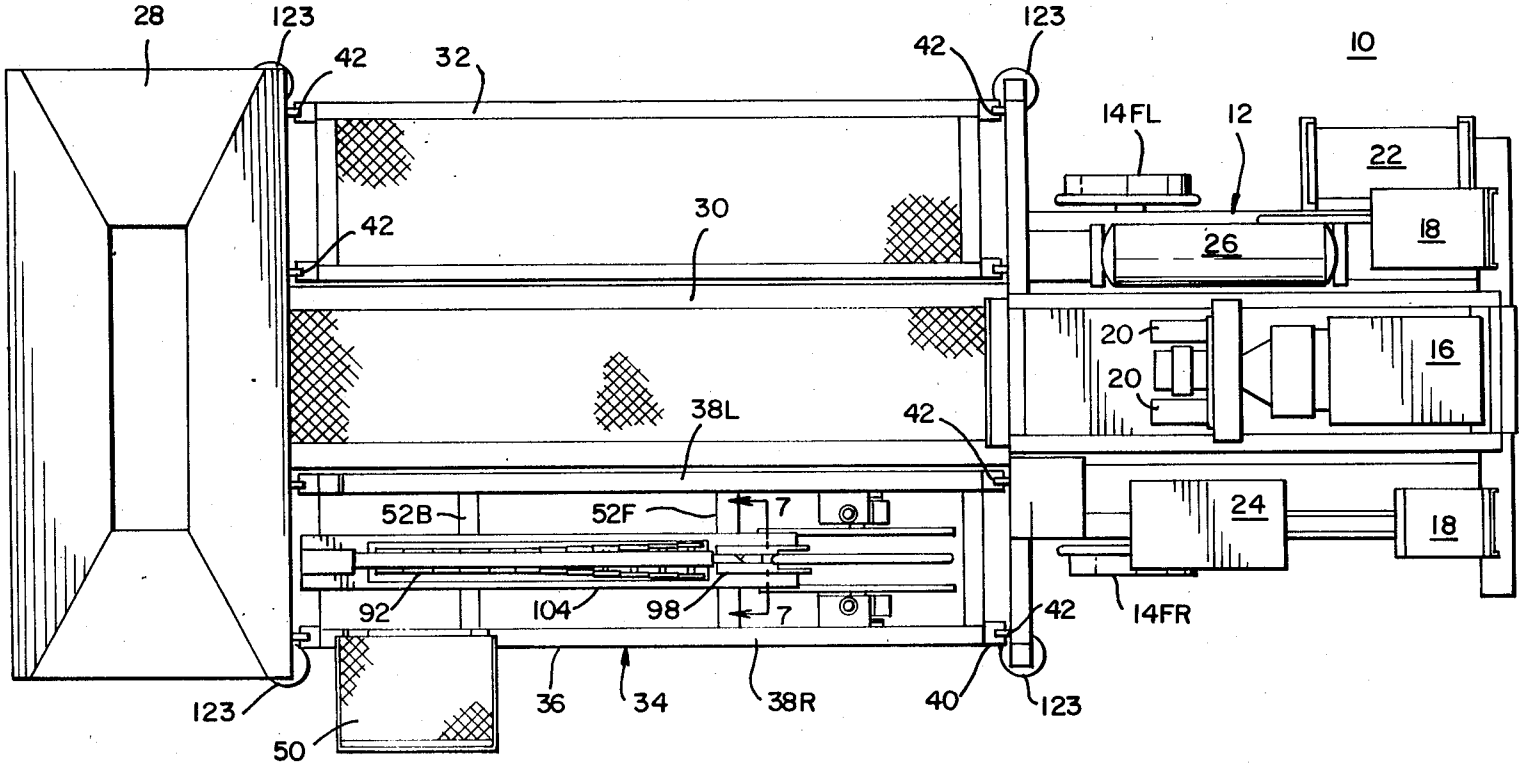
FIG. 2 shows a simplified top view of the vehicle of FIG. 1.

As best shown in FIG. 1, the conveyor 58 extends in a closed loop longitudinally along the placer assembly 34. The conveyor 58 is flexible in that, like a conveyor belt, it includes portions which may flex or move relative to other portions. For example, the conveyor 58 is preferably a crawler track with a plurality of links connected together for relative pivoting therebetween. A possible configuration for the conveyor 58 is shown in FIG. 6, but other configurations could of course be used. The conveyor 58 is a moving conveyor in that it moves articles by movement of the conveyor itself. The conveyor 58 is generally perpendicular to the ties 64.

Mounted at the back of the crawler assembly 34 is a crawler drive motor 68 and a drive sprocket for causing the conveyor 58 to move in a clockwise (FIG. 1 view) direction.

Figure 5:
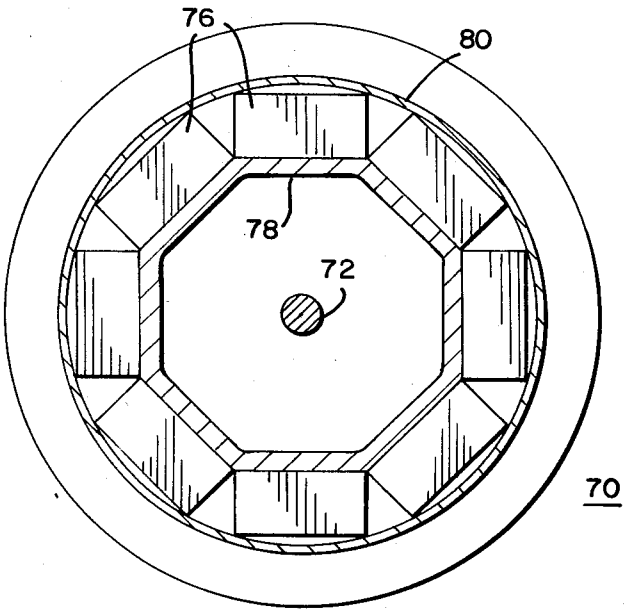
FIG. 5 shows a cross sectional view of some parts taken along lines 5—5 of FIG. 3.
Figure 3:
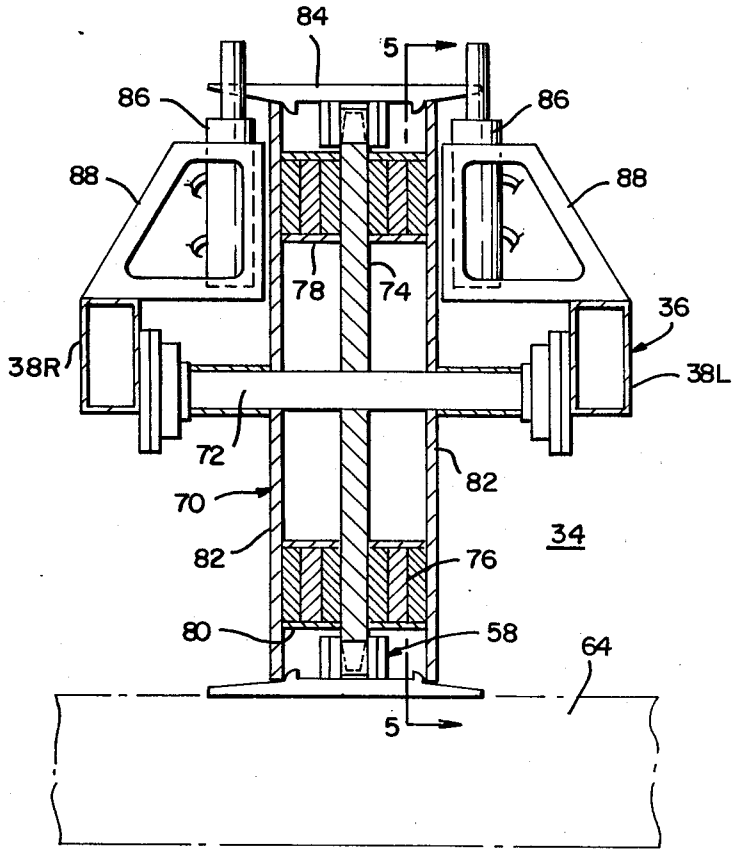
FIG. 3 shows a cross sectional view of some parts taken along lines 3—3 of FIG. 1.

Considering now FIGS. 1 and 3 in conjunction with the FIG. 5 cross sectional view taken along lines 5—5 of FIG. 3, a magnetic wheel 70 is mounted for rotation upon a shaft 72 extending between the members 38R and 38L. The magnetic wheel 70 includes a sprocket 74 meshed to the conveyor 58 and symmetric arrangements of permanent magnets 76 on each side of the sprocket 74. The magnets 76 may be arranged in 8 sets of magnets, 3 magnets in each set, for each side of the sprocket 74. The magnets 76 are held between an 8-sided inner ring 78 and a circular outer ring 80. There is one inner ring 78 and outer ring 80 for each side of the sprocket 74.

The magnets 76 are arranged to form a series circuit also extending through a pair of outer disks 82, which are made of magnetic metal to serve as pole pieces in establishing a magnetic circuit through a tie plate 84 as illustrated at the top of FIG. 3. The outer ring 80 is preferably made of stainless steel to minimize the effects of the magnets 76 upon the conveyor 58 itself.

Figure 4:
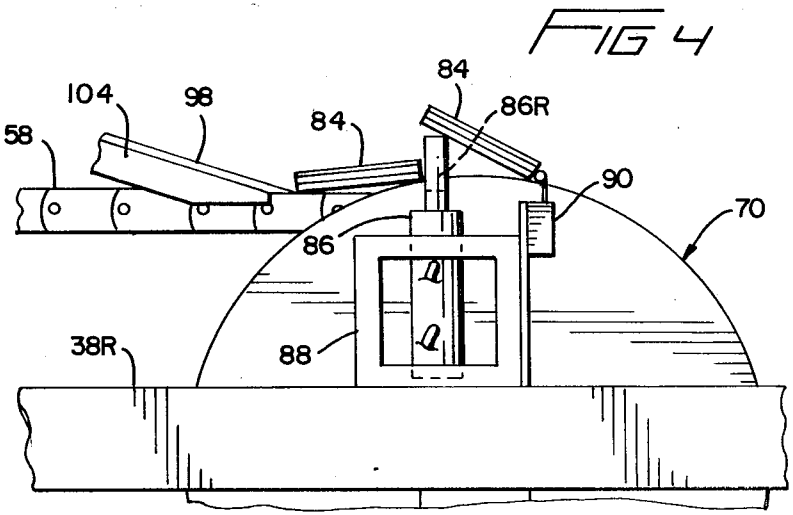
FIG. 4 shows an enlarged view of a gating arrangement used with the present invention.

Pneumatic cylinder gates 86 (FIGS. 1, 3, and 4) are mounted upon brackets 88 and used for gating tie plates onto the conveyor 58. A plate detect microswitch 90 is mounted upon one of the brackets 88. With reference to FIGS. 1, 2, and 4, a roller conveyor 92 having rollers 94 may serve as a conveying means for feeding tie plates onto the lower conveyor 58. The roller conveyor 92 is mounted upon support members 96 extending from the placer assembly frame 36. Although the pneumatic cylinder gates 86 are mechanical blocking gates, the term "gates" as used herein shall include any means which may alternately "open" (i.e., allow passage) to allow movement of an article and "block" (i.e., prevent passage) to restrain against movement. For example, a suction conduit could be used as a gate to control the flow of tie plates onto conveyor 58. Tie plates may procede down the roller conveyor 92 to the crawler track conveyor 58 and be deposited thereon adjacent the gates 86.

Figure 8:
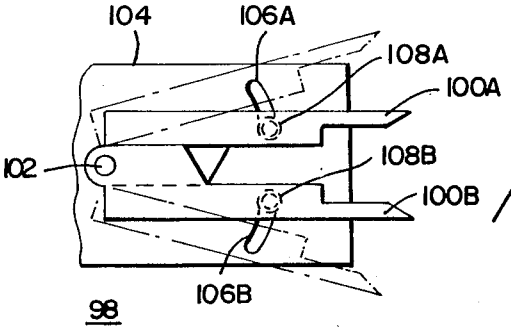
FIG. 8 shows a top enlarged view of the adjustment mechanism.
Figure 7:
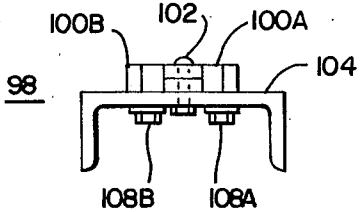
FIG. 7 shows a cross sectional view of an adjustment mechanism taken along lines 7—7 of FIG. 2.

In order to properly position the tie plates 84 upon the conveyor 58, a tie plate width accommodation mechanism 98 is shown in FIGS. 1, 4, 7, and 8. To adjust for different distances between the ridges of tie plates, the mechanism 98 includes two finger members 100A and 100B which are pivotably connected together at pivot point 102. A support member 104, which is a frame for the roller conveyor 92, may include slots 106A and 106B to accommodate different positions of the fingers 100A and 100B. Specifically, the solid line position of FIG. 8 shows the mechanism 98 adjusted for a tie plate having a shorter distance between its ridges. The fingers 100A and 100B are respectfully bolted in position by bolts 108A and 108B extending through the slots 106A and 106B and into the underside of the finger members 100A and 100B. The bolts 108A and 108B could extend up from the bottom of the slots 106A and 106B into holes on the underside of the fingers 100A and 100B or, alternately, could be mounted in countersunk holes upon the top of the finger members 100A and 100B.

From the solid line position of the finger members 100A and 100B in FIG. 8, the mechanism 98 may be adjusted to accommodate tie plates having greater width between their ridges by removing the bolts 108A and 108B and pivoting the finger members 100A and 100B outwardly to assume the phantom line positions of FIG. 8, whereupon the bolts 108A and 108B are used to secure the fingers in their outer positions. In either the narrow solid line position of FIG. 8 or the wide phantom line position of FIG. 8, the fingers 100A and 100B have the illustrated shape such that the conveyor 58 may pass between the tips of the fingers and the fingers insure that the tie plates are properly positioned upon the conveyor 58.

Figure 9:
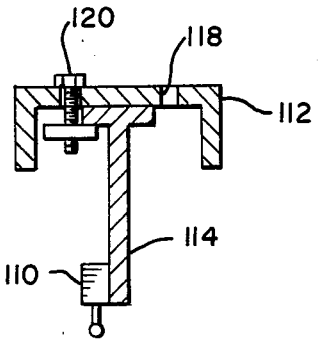
FIG. 9 shows a cross sectional view taken along lines 9—9 of FIG. 1.

With reference to FIGS. 1 and 9, a tie detector microswitch 110 is mounted upon a skid comprising a channel member 112 and a T member 114. The channel member 112 is pivotably mounted at pivot point 116 attached to a downwardly projecting member 117 of the placer frame 36. The member 114 may be adjusted for longitudinal position relative to channel member 112 by virtue of front and back pairs of holes 118 (only one hole visible in FIG. 9) through which front and back pairs of bolts 120 (only one bolt shown in FIG. 9) may extend. The member 114 may be slid forward or backward by loosing the front and back pair of bolts 120. The bolts 120 may then be retightened to secure the member 114 to the channel member 112. A limit chain 140 prevents the skid from pivoting so far down that the skid might jam the machine against forward movement.

The tie detector switch 110 is preferably positioned such that the detect point (the point at which its switch arm extends for detection of a tie) is spaced from a release point 122 (FIG. 1, a point at which tie plates upon conveyor 58 are placed upon a tie 64) equal to the distance (i.e., around the conveyor 58) from the gates 86 to the release point 122. The significance of this relationship in distances will be better understood when the operation of the invention is discussed below.

Figure 10:
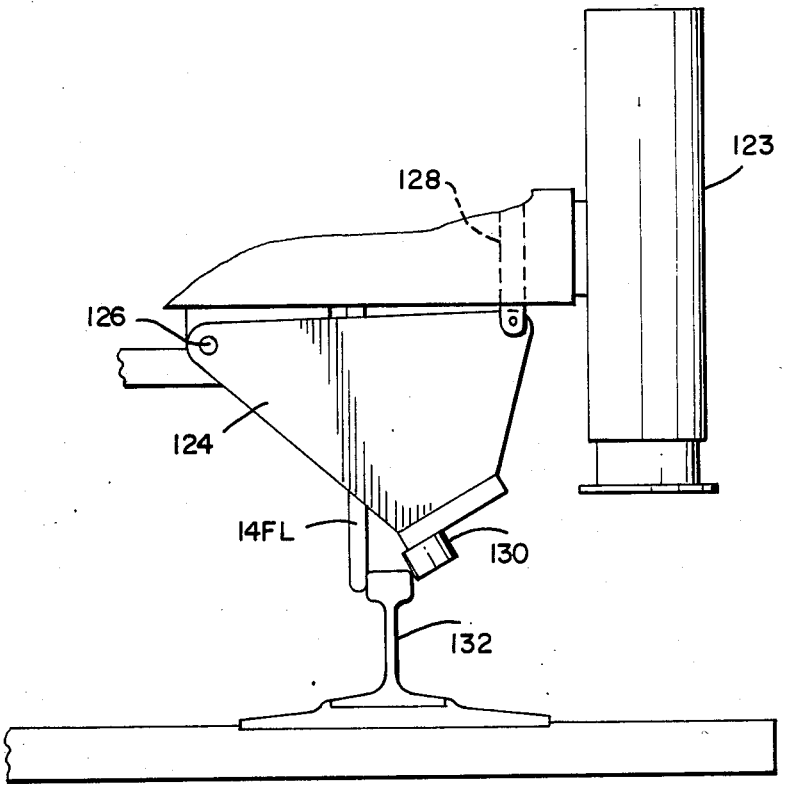
FIG. 10 shows a simplified front view illustrating a technique for holding the vehicle upon a single rail.

When the vehicle 10 has moved along a pair of rails by way of its wheels 14FR, 14FL, 14BR, 14BL until it reaches a point whereat plate placing is required, there will be only one rail on which the vehicle 10 may ride. Accordingly, a gauging wheel arrangement such as shown in FIG. 10 may be used. In particular, a support plate 124 is pivotably mounted at pivot point 126 fixed to the frame of the vehicle 10. The support plate 124 is pressed downwardly by a member 128 in order to bias a roller 130 against the rail 132. The link 128 may have an air brake chamber (not shown) attached to its top to press downwardly on the plate 124 and bias the roller 130 so as to capture the rail 132 between the roller 130 and the wheel 14FL. A similar arrangement would be used at the back wheel such that the vehicle 10 may proceed upon a single rail.

Before leaving a double rail area of track and after the gauging wheels or rollers 130 have been properly positioned, two of the four outriggers 123 will be extended so as to support one side of the vehicle 10. In particular, the outriggers 123 would be extended to support the side of the vehicle 10 on which the plate placer is mounted such that the plate placer 34 may then be lowered from an upper position captured between the upper holes 46 and a lower position, shown in FIG. 1. Before the plate placer 34 is lowered, the vehicle 10 should have its left side wheels upon a rail and the back right side wheel upon a rail whereas the front right wheel will not be in contact with a rail, but the right side outriggers 123 will be extended. Upon lowering the plate placer 34 and securing it in position, the outrigger jacks 123 may be retracted and the vehicle 10 may proceed by virtue of propulsion and support by the crawler track 58 in addition to having the opposite side supported and propelled by the back left wheel. It will thus be appreciated that at the crawler track conveyor 58 applies at least a portion of the weight of the vehicle to the ties by way of the tie plates.

As shown by the simplified schematic of FIG. 11, the hydraulic pump 20 feeds hydraulic oil to a rear axle drive motor 134 in parallel to the motor 68 which drives the crawler or conveyor 58 by way of sprocket 68S. By hooking up the motors 134 and 68 in parallel in the hydraulic circuit, the motors are in effect geared to the ground and will run at an appropriate speed to stay in synchronization with each other. This avoids possible slippage which might otherwise occur if the motor 134 and 68 operated at different speeds.

With reference to FIG. 12, a simplified electric and pneumatic arrangement for the present invention is shown. The battery 26 is connected to a solenoid coil 136 by way of the normally open tie detector switch 110 and the normally closed plate detector switch 90. The solenoid 136 controls a valve 138 which connects pressurized air and exhaust conduits to the parallel connection of the pneumatic gates 86.

Operation

As the vehicle 10 proceeds along a railroad track under the power of the crawler track conveyor 58 in addition to one of its rear wheels upon a rail, the tie detector switch 110 will be closed for each tie which is detected. One or more persons on the various platforms of the vehicle may be removing tie plates from the bin 28 and placing them upon the roller conveying means 92, the mechanism 98 having been set for the tie plates which are to be placed. The tie plates will stack up in a line behind (i.e., to the left in FIGS. 1 and 4) the gates 86.

Upon the tie detector 110 detecting a tie 64, the closing of the switch 110 (FIG. 12) will switch the valve 138 to reverse the flow of air to gates 86 and cause the retraction of the pneumatic gates 86 to a retracted position shown as 86R in FIG. 4. A tie plate 84 may then easily pass over the gates 86 moving with the conveyor 58 and fixed to the magnetic wheel 70 by the permanent magnets 76 (FIG. 3). When the tie plate 84 contacts the switch arm of plate detect switch 90, it opens the switch 90, causing the valve 138 to return the gates 86 to their extended position. By placing the plate detect switch 90 closer to the gate 86 then the length of the tie plates 84, the gates 86 will resume their extended or blocking state and push up on the tie plate 84 as illustrated in FIG. 4. However, the plate will have sufficiently cleared the gates 86 such that it may continue around from the upwardly facing portion of the plate conveying surface of conveyor 58 to the transitional or sideway facing portion of the conveyor 58. The tie plate 84 may freely pass by the switch arm plate detect switch 90. By causing the gates 86 to resume their blocking state before a leading (i.e., at the front of the line at gates 86) tie plate 84 has completely passed the gates 86, the arrangement ensures that only a single plate may pass for each tie detected by the tie detect switch 110. By the time the tie plate has cleared plate switch 90 such that the switch 90 recloses, the tie detect switch 110 will have cleared the tie and reopened. Therefore, the gates 86 will not reopen until the switch 110 detects the next tie.

As shown in FIG. 1, the tie plates 84 may proceed along the conveyor 58 and magnetic wheel 70, the permanent magnets of which serve as a holding means to secure the tie plates 84 against the conveyor 58 as the plate conveying or outer surface of the conveyor 58 curves from its upwardingly facing portion to a downwardly facing portion adjacent the release point 122. When a tie plate 84 reaches the release point 122, this corresponds to the tie plate 84 hitting a tie 64 and being deposited thereon. The tie plate 84 is placed on the tie and released in the sense that it no longer moves with the vehicle 10, but instead is stationary relative to the ground and ties 64. The weight of the vehicle 10 upon the tie plate 84 ensures that it will not move. Additionally, as the movement of the crawler track 58 is at the same speed as the movement of the vehicle 10, the portion of crawler track 58 which is contacting deposited ties is not moving horizontally with respect to the tie plates which have already been placed. Instead, the tie plates 84 will remain stationary with respect to the conveyor 58 until the vehicle has moved sufficiently forward that the conveyor portion immediately above the placed tie plate is lifted off the tie plate by the drive motor 68. The weight of the vehicle 10 and the position of the conveyor 58 prevents the tie plates 84 from moving back upwardly around the magnetic wheel 70 such that the tie plate 84 is "released" from the holding means of magnets 76 within the magnetic wheel 70.

For each closing of the tie detect switch 110, a tie plate 84 will be released by the gates 86. It is preferable to have the gates 86 open immediately upon (i.e., with only the very slight lag inherent in the response time of the FIG. 12 arrangement) tie detection, but the use of additional delays is also possible. The advantage of having the detect point of tie detector 110 at the same tie plate path distance from the release point 122 as the distance between the gates 86 and release points 122 (i.e., meaning the distance traveled by a tie plate as it travels from gates 86 to point 122) is that this arrangement will provide proper tie plate placement independent of variations in speed because the time of travel of a tie plate from the gates 86 to the release point 122 should be equal to the time required by the vehicle 10 to move sufficiently that the release point 122 is disposed immediately above tie 64 whose detection triggered the gating of the particular tie plate.

Although various specific constructions have been discussed and shown herein, these are for illustrative purposes only. Various adaptations and modifications will be apparent to those of skill in the art. For example, the preferred embodiment uses a magnetic wheel and a flexible conveyor such as a crawler track, but alternate versions of the invention (in its broad aspects) might be realized by using only the magnetic wheel or only the flexible conveyor as a plate placing closed loop conveyor. Accordingly, the scope of the present invention should be determined by reference to the claims appended hereto.

What is claimed is:

1. A rail tie plate placing vehicle comprising:

(a) a main frame;

(b) a moving conveyor extending in a closed loop, said conveyor supported by said main frame and operable in a plate placing mode to place tie plates upon ties of a railroad track as the vehicle moves down the railroad track;

(c) a first gate for gating the conveyance of tie plates by said conveyor, said first gate disposable in a blocking state wherein it blocks the conveyance of a leading tie plate and disposable in an open state wherein it allows passage of a leading tie plate for conveyance by movement of said conveyor;

(d) holding means for holding tie plates against said conveyor and allowing the release of tie plates at a common predetermined release point on said closed loop for immediate disposal upon a tie; and (e) a tie detector supported by said main frame for detection of ties at a detection point forward of said release point; and wherein said tie detector causes said first gate to open for passage of a tie plate corresponding to the detection of a tie such that the tie plate which was allowed passage by said first gate arrives at said release point when said vehicle has moved said release point over the detected tie.

2. The rail tie plate placing vehicle of claim 1 wherein said conveyor is operable to propel said vehicle along a track.

3. The rail tie plate placing vehicle of claim 2 wherein said conveyor applies at least a portion of the weight of the vehicle to the ties by way of the tie plates.

4. The rail tie plate placing vehicle of claim 3 wherein said conveyor is a crawler track.

5. The rail tie plate placing vehicle of claim 1 wherein said conveyor is a flexible conveyor having a plate conveying surface with an upwardly facing portion, a downwardly facing portion, and a transitional portion between said upwardly facing portion and said downwardly facing portion, and further comprising holding means cooperating with said conveyor for holding tie plates against said transitional portion and said downwardly facing portions of said plate conveying surface and for releasing tie plates at said release point, said release point being disposed at said downwardly facing portion.

6. The rail tie plate placing vehicle of claim 5 further comprising a magnetic wheel rotating upon movement of said conveyor, and wherein said holding means comprises a plurality of permanent magnets mounted to said magnetic wheel.

7. The rail tie plate placing vehicle of claim 6 wherein said conveyor is a crawler track disposed to crawl on a railroad track.

8. The rail tie plate placing vehicle of claim 6 wherein said tie detector is a switch mounted for actuation by ties.

9. The rail tie plate placing vehicle of claim 1 wherein the tie plate path distance from said first gate to said release point is equal to the distance from said detection point to said release point, and said tie detector causes said first gate to assume its open state immediately upon detection of a tie.

10. The rail tie plate placing vehicle of claim 1 further comprising a plate detector for detection of a tie plate at a place on said conveyor downstream of said first gate, and wherein said plate detector is operable to cause said first gate to assume its blocking state prior to complete passage of a leading tie plate past the first gate such that the leading tie plate moves with said conveyor, but any following tie plates are blocked.

11. The rail tie plate placing vehicle of claim 1 wherein said first gate is mounted adjacent a first side of said conveyor, and further comprising a second gate mounted adjacent a second side of said conveyor and operable in like fashion with said first gate for simultaneously gating tie plates by joint action of said first and second gates.

12. A rail tie plate placing vehicle comprising:

(a) a main frame;

(b) a moving, closed loop, flexible conveyor supported by said main frame and operable in a plate placing mode to place tie plates upon ties of a railroad track, and wherein said conveyor includes a plate conveying surface having an upwardly facing portion, a downwardly facing portion and a transitional portion between said upwardly facing portion and said downwardly facing portion; and (c) holding means cooperating with said conveyor for holding tie plates against said transitional and downwardly facing portions of said plate conveying surface and for releasing tie plates at a release point from said downwardly facing portion for placement upon ties, and wherein said conveyor is disposed such that it contacts a tie plate at the same time as the tie plate contacts a tie.

13. The rail tie plate placing vehicle of claim 12 wherein said conveyor applies at least a portion of the weight of the vehicle to the ties by way of the tie plates.

14. The rail tie plate placing vehicle of claim 13 wherein said conveyor is a crawler track.

15. The rail tie plate placing vehicle of claim 14 further comprising a magnetic wheel rotating upon movement of said conveyor, and wherein said holding means comprises a plurality of permanent magnets mounted to said magnetic wheel.

16. The rail plate placing vehicle of claim 12 wherein said conveyor is a crawler track disposed to crawl on a railroad track.

17. The rail tie plate placing vehicle of claim 16 further comprising a first gate for gating the conveyance of tie plates by said conveyor, said first gate disposable in a blocking state wherein it blocks the conveyance of a leading tie plate and disposable in an open state wherein it allows passage of a leading tie plate for conveyance by movement of said conveyor, and a tie detector supported by said main frame for detection of ties at a detection point forward of said release point; and wherein said tie detector causes said first gate to open for passage of a tie plate corresponding to the detection of a tie, and wherein said conveyor is operable such that the tie plate which was allowed passage by said first gate arrives at said release point when said vehicle has moved said release point over the detected tie.

18. The rail tie plate placing vehicle of claim 17 wherein said tie detector is a switch mounted for actuation by ties.

19. The rail tie plate placing vehicle of claim 17 further comprising a plate detector for detection of a tie plate at a place on said conveyor downstream of said first gate, and wherein said plate detector is operable to cause said first gate to assume its blocking state prior to complete passage of a leading tie plate past the first gate such that the leading tie plate moves with said conveyor, but any following tie plates are blocked.

20. The rail tie plate placing vehicle of claim 17 wherein said first gate is mounted adjacent a first side of said conveyor, and further comprising a second gate mounted adjacent a second side of said conveyor and operable in like fashion with said first gate for simultaneously gating tie plates by joint action of said first and second gates.

21. The rail tie plate placing vehicle of claim 17 further comprising an inclined conveying means having a plate placement surface adapted to receive tie plates thereon for movement to a lower end of said conveying means, and wherein said lower end terminates above said conveyor such that tie plates placed on said conveying means are deposited upon said conveyor.

22. The rail tie plate placing vehicle of claim 12 further comprising a magnetic wheel rotating upon movement of said conveyor, and wherein said holding means comprises a plurality of permanent magnets mounted to said magnetic wheel.

23. A method of placing rail tie plates upon ties from a tie plate placing vehicle, the steps comprising:

(a) moving the vehicle along a railroad track;

(b) detecting ties on the railroad track;

(c) automatically gating a tie plate by way of a first gate for movement with a closed loop, moving conveyor for each detected tie, each gating of a tie plate resulting from a corresponding detection of a tie;

(d) moving each gated tie plate to a release point of said conveyor such that the gated tie plate is at the release point when the vehicle has moved sufficiently that the release point is immediately over the detected tie whose detection caused the gating of that gated tie plate; and (e) releasing each gated tie plate from further movement with the vehicle when it arrives at said release point.

24. The method of claim 23 wherein each tie plate is gated for movement with the conveyor upon the detection of a tie.

25. The method of claim 23 wherein said conveyor is moving at the same speed as said vehicle.

26. The method of claim 25 further comprising the step of propelling the vehicle by movement of said conveyor and wherein the vehicle is moving during said releasing step.

27. The method of claim 26 wherein the conveyor is a crawler track which contacts the railroad track and said releasing step results at least partially from the weight of the vehicle causing tie plates to stop moving with the vehicle such that each tie plate is deposited on a tie.

28. The method of claim 27 further comprising the steps of detecting plates at a place on said conveyor downstream of said first gate and causing the first gate to assume a blocking state upon detection of a plate.

29. The method of claim 23 further comprising the step of holding tie plates to the conveyor by permanent magnets in a magnetic wheel which rotates upon movement of said conveyor.

30. The method of claim 23 wherein said releasing step occures upon a tie plate contacting a tie, while the tie plate is still in contact with the conveyor.

* * * * *